US012042098B1

(12) United States Patent
Roth

(10) Patent No.: US 12,042,098 B1
(45) Date of Patent: Jul. 23, 2024

(54) TOWEL HANGING DEVICE

(71) Applicant: Irena Roth, Saint Louis, MO (US)

(72) Inventor: Irena Roth, Saint Louis, MO (US)

( * ) Notice: Subject to any disclaimer, the term of this patent is extended or adjusted under 35 U.S.C. 154(b) by 57 days.

(21) Appl. No.: 17/895,026

(22) Filed: Aug. 24, 2022

(51) Int. Cl.
*A47K 10/12* (2006.01)
*A47K 10/10* (2006.01)

(52) U.S. Cl.
CPC ..... *A47K 10/10* (2013.01); *A47K 10/12* (2013.01)

(58) Field of Classification Search
CPC ..... A47K 10/10; A47K 10/12; Y10T 24/32; A44D 2203/00; A41F 1/002
See application file for complete search history.

(56) References Cited

U.S. PATENT DOCUMENTS 3,159,281 A 12/1964 Hutter et al.
4,885,195 A 12/1989 Change, III
5,682,653 A * 11/1997 Berglof ..... G09F 1/10 224/183
6,836,899 B1 * 1/2005 Glasmire ..... A45F 5/04 24/9
7,322,068 B1 1/2008 Kim
D611,678 S * 3/2010 Bailey ..... D2/624
7,955,683 B1 6/2011 Ferrell et al.
8,479,685 B2 * 7/2013 Sprung ..... A01K 63/006 119/51.04
9,392,914 B2 7/2016 Barringer
9,867,409 B1 1/2018 Mroz
10,322,325 B2 6/2019 Farina et al.
10,583,339 B2 3/2020 Farina et al.
D966,934 S * 10/2022 Walker ..... D8/395
2005/0023420 A1 * 2/2005 Sadeh ..... B42F 11/04 248/206.5
2005/0283953 A1 * 12/2005 Jeffrey ..... A47K 10/14 24/303
2010/0083699 A1 * 4/2010 Conigliaro ..... A45F 5/02 24/303
2010/0116955 A1 * 5/2010 Hayes ..... B29C 39/26 248/206.5
2010/0325842 A1 * 12/2010 Rivera ..... G09F 21/02 24/3.4
2012/0125046 A1 * 5/2012 Vander Wal ..... H01F 7/0263 24/303
2014/0034689 A1 * 2/2014 Moradzadeh ..... A47G 25/743 248/309.4
2014/0250640 A1 * 9/2014 Crooks ..... A41F 19/00 24/303
2015/0074954 A1 * 3/2015 Pruitt ..... A44C 5/2071 24/303
2019/0060724 A1 * 2/2019 Farina ..... A63B 57/60
2021/0018024 A1 * 1/2021 Meyran ..... F16B 2/06

OTHER PUBLICATIONS 8 pcs Towel Clips Towels Hanger Tea Towel Towel Hook. Product Listing [online]. © 2022 Walmart [retrieved on Oct. 25, 2021]. Retrieved from the Internet: <URL: https://www.walmart.com/ip/8-pcs-Towel-Clips-Towels-Hanger-Tea-Towel-Towel-Hook/215059693?wmlspartner=wlpa&selectedSellerId=101047887>.

* cited by examiner

*Primary Examiner* — Robert Sandy
*Assistant Examiner* — Rowland Do
(74) *Attorney, Agent, or Firm* — Cramer Patent & Design PLLC; Aaron R. Cramer

(57) ABSTRACT

A towel hanger device is a bath towel hanging apparatus having a silicon loop secured to a magnetic clip capable of retaining a towel between each portion of the magnetic clip. The clip may come in a variety of shapes while the a spring biased hinge may also be utilized in lieu of/or addition to the magnets.

14 Claims, 6 Drawing Sheets

TOWEL HANGING DEVICE

RELATED APPLICATIONS

None

FIELD OF THE INVENTION

The present invention relates generally to hanging device and more specifically to a hanging device for towels.

BACKGROUND OF THE INVENTION

As anyone with a swimming pool, shower and/or bathtub knows—a dry towel in a handy spot is a must have. Sometimes, easily located and sufficiently dry towels are hard to find. Additionally, towels in bathrooms often end up thrown or fallen on the floor—where they don't dry and become wrinkled. This may be the result of laziness or a towel rack that is not suitable for the size and number of towels needed. Regardless of the reason, there exists a need for a means by which a towel may be easily utilized and hung on a towel rack. The development of the towel hanging device fulfills this need.

SUMMARY OF THE INVENTION

The principles of the present invention provide for a holding device which has a body first half, a body second half mating with the body first half that are adapted to hold an article and have an overall ornamentation, and a loop having a first end and a second end, the first end of the loop is attached, affixed, or otherwise bonded to an upper side of the body first half and the second end of the loop is attached, affixed, or otherwise bonded to the upper side of the body second half.

The body first half and the body second half may be made of a soft, waterproof, and resilient synthetic silicone material that retains its shape after being manipulated. The overall ornamentation may include an animal-like appearance. The loop may include a first receiver and a second receiver. The first receiver may include a first receiver cradle disposed on a first side thereof. A first magnet may be attached to the terminal portion of the first end of the loop and is retained within the first receiver cradle. The first magnet may be permanently attached within the first cradle but is retained thereon. The first magnet may be removably attached within the first cradle but is retained thereon. The first magnet may be retained within the first receiver of the first body half it is magnetically attracted to a second magnet located within the second receiver of the second body half. The second receiver cradle may be located on a first side thereof.

A second magnet may be attached to the terminal portion of the second end of the loop and is retained within the second receiver cradle. The second magnet may be permanently attached within the second cradle but is retained thereon. The second magnet may be removably attached within the second cradle but is retained thereon. The loop first end may be attached, affixed, or otherwise bonded to a first clip grip and the loop second end is attached, affixed, or otherwise bonded to a second clip grip. Extending away from the first clip grip may be a first clip jaw with a tip of the first clip jaw terminating prior to the inner wall of the body and the inner side of the first clip jaw is parallel to a first inner wall of the cavity. Extending away from the second clip grip may be a second clip jaw with a tip of the second clip jaw terminating prior to the inner wall of the body and the inner side of the second clip jaw is parallel to a second inner wall of the cavity.

A hinge may operatively connect the first clip grip to the second clip grip and designates the transition of the first clip grip to the first clip jaw and the second clip grip to the second clip jaw. The hinge may be a torsion spring to bias the first clip jaw and the second clip jaw towards each other, closing the cavity, thereby creating a "closed" configuration. The first clip grip and the second grip may clip towards each other forces the first clip jaw and the second clip jaw to move away from each other and effectively opening the cavity, thereby creating an "open" configuration. The loop may be made of material that allows the clip to retain a desired shape when manipulated that maintains durability and resistance to over-stretching and/or severing.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
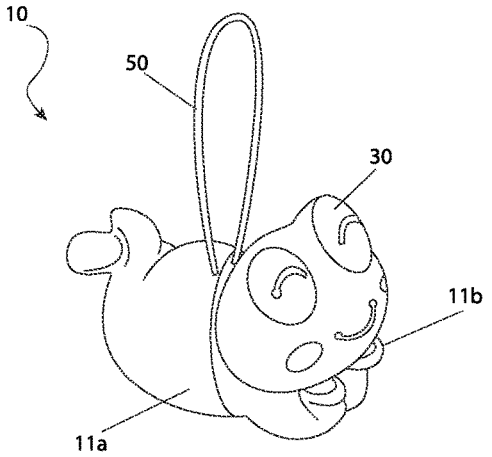
FIG. 1 is a perspective view of a holding device, wherein a first body half is mated to a second body half, according to a preferred embodiment of the present disclosure.

10 holding device
11*a* body first half

11*b* body second half
12 first clip grip
14 second clip grip
15 hinge
16 loop first end
18 first clip jaw
20 loop second end
22 second clip jaw
25 first clip magnet
26 second clip magnet
30 body
31 ornamentation
35 cavity
40 first magnet
41 first receiver
42 first receiver cradle
45 second magnet
46 second receiver
47 second receiver cradle
50 loop
S support structure
T towel

DESCRIPTION OF THE PREFERRED EMBODIMENTS

Figure 2:
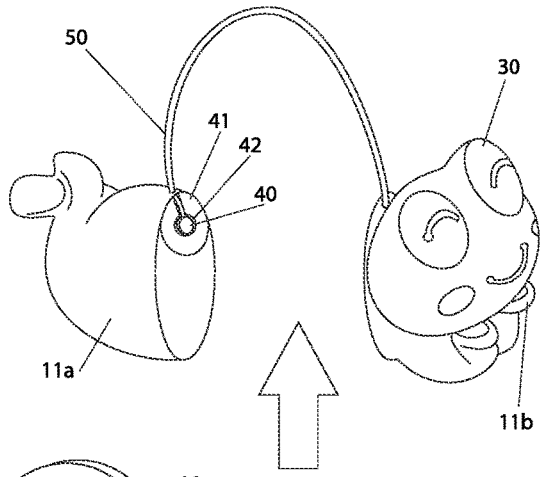
FIG. 2 is a perspective view of the holding device, wherein the first body half and second body half are detached from each other, according to a preferred embodiment of the present disclosure.
Figure 3:
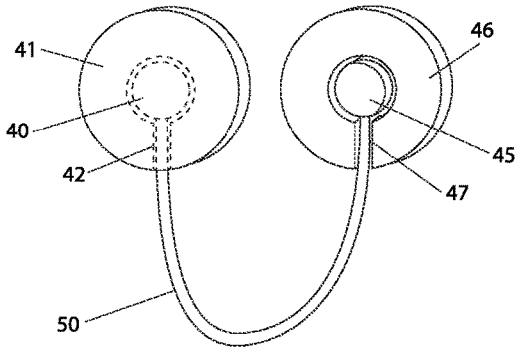
FIG. 3 is a close-up view of a first magnet in a first receiver and a second magnet in a second receiver, according to a preferred embodiment of the present disclosure.

The best mode for carrying out the invention is presented in terms of its preferred embodiment, herein depicted within FIGS. 1 through 3, and in alternate embodiments within FIGS. 4-8. However, the invention is not limited to the described embodiments, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIGS. 1-3 a preferred embodiment of the holding device 10, is herein disclosed. The holding device 10 is configured to include a body first half 11*a* and a body second half 11*b*, which, when mating together, provides the ability to hold an article, for example, a towel T and support the holding device 10 and held towel T on a support structure S via a loop 50. The holding device 10 in at least one (1) embodiment resembles a body first half 11*a* that is capable of removable attachment to a body second half 11*b*. When combined, the body first half 11*a* and body second half 11*b* combine to have an overall ornamentation 31. Other shapes for the body first half 11*a* and body second half 11*b* and multiple styles or textures or indicia can be construed as the ornamentation 31. Other embodiments are envisioned where there is an absence of ornamentation 31. In the exemplary embodiment of the body first half 11*a* and body second half 11*b*, the ornamentation 31 takes on a generally decorative anthropomorphic animal or animal-like appearance. The body first half 11*a* and body second half 11*b* is constructed out of a soft, waterproof, and generally resilient synthetic material capable of retaining its shape after being manipulated, such as a soft silicone-based material. A first end of the loop 50 is attached, affixed, or otherwise bonded to an upper side of the body first half 11*a*. A second end of the loop 50 is attached, affixed, or otherwise bonded to the upper side of the body second half 11*b*. The portion of the loop 50 outside the body first half 50 may be at least twice as long as the thickness of the body first half 11*a* and body second half 11*b*, although other dimensions are appreciated. The material of the loop 50 may be such that the clip retains a desired shape when manipulated thereto. The loop 50 material maintains durability and resistance to over-stretching and/or severing when holding a towel T from a support structure S.

Referring now more closely to FIG. 3, a first receiver 41 is generally disk-shaped and has a first receiver cradle 42 located on a first side thereof. The second side of the first receiver 41 is generally planar. A first magnet 40 is attached to the terminal portion of the first end of the loop 50 and is retained within the first receiver cradle 42. The first magnet 40 may be permanently or removably attached within the first cradle 41 but is capable of being retained thereon. The first receiver 41 may be attached to or integral with, the body first half 11*a*. A second receiver 46 is generally disk-shaped and has a second receiver cradle 47 located on a first side thereof. The second side of the second receiver 46 is generally planar. A second magnet 45 is attached to the terminal portion of the second end of the loop 50 and is retained within the second receiver cradle 47. The second magnet 45 may be permanently or removably attached within the second cradle 46 but is capable of being retained thereon. The second receiver 46 may be attached to or integral with, the body second half 11*b*. When the first magnet 40 is retained within the first receiver 42 of the first body half 11*a* it is magnetically attracted to a second magnet 45 located within the second receiver 46 of the second body half 11*b*.

Figure 4:
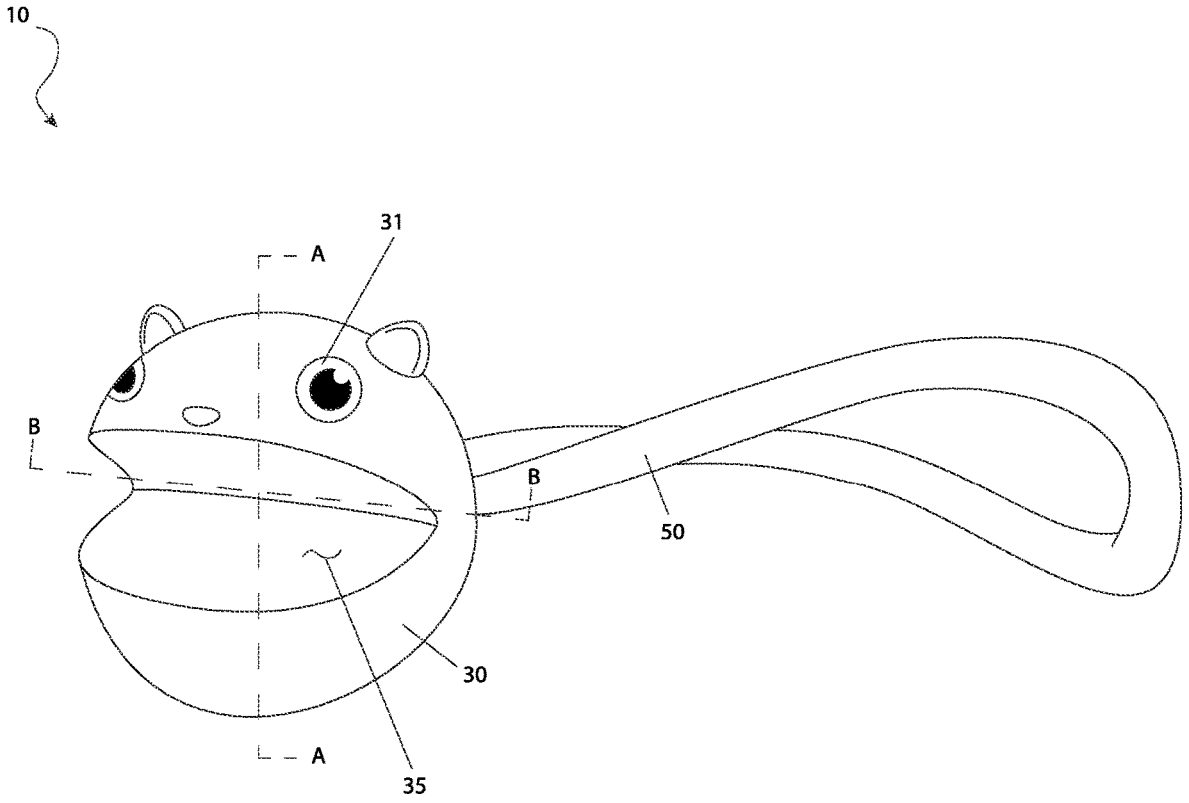
FIG. 4 is a perspective view of the holding device, according to an alternate embodiment of the present disclosure.

Referring now to FIG. 4, a perspective view of the holding device 10, according to the alternate embodiment of the present invention is disclosed. The holding device 10 is configured to include a body 30 to hold an article, for example, a towel T and supported on a support structure S via a loop 50 attached to the body 30. The holding device 10 in at least one (1) embodiment resembles a generally spherical body 30 with ornamentation 31 located thereon and a cavity 35 extending at least partially inward from said body 30 and selectively accessible. Other shapes for the body 30 and multiple styles or textures or indicia can be construed as the ornamentation 31. Other embodiments are envisioned where there is an absence of ornamentation 31. In the exemplary embodiment of the body 30, the ornamentation 31 takes on a generally decorative "monster" or animal-like appearance and the cavity 35 resembles the mouth in the same theme as the ornamentation 31. The body 30 is constructed out of a soft, waterproof, and generally resilient synthetic material capable of retaining its shape after being manipulated, such as a soft silicone-based material.

An elastic silicone-based material serves as the preferred material for the loop 50. A loop first end 16 and a loop second end 20 are each retained within the body 30, whereas the remainder portion of the loop 50 passes through the body 30 and back into the body 30 to form the shape of the loop 50. The length of the portion of the loop 50 outside the body 30 may be at least twice as long as the length of the body 30, although other dimensions are appreciated. The material of the loop 50 may be such that the clip retains a desired shape when manipulated thereto. The loop 50 material maintains durability and resistance to over-stretching and/or severing when holding a towel T from a support structure S.

Figure 6A:
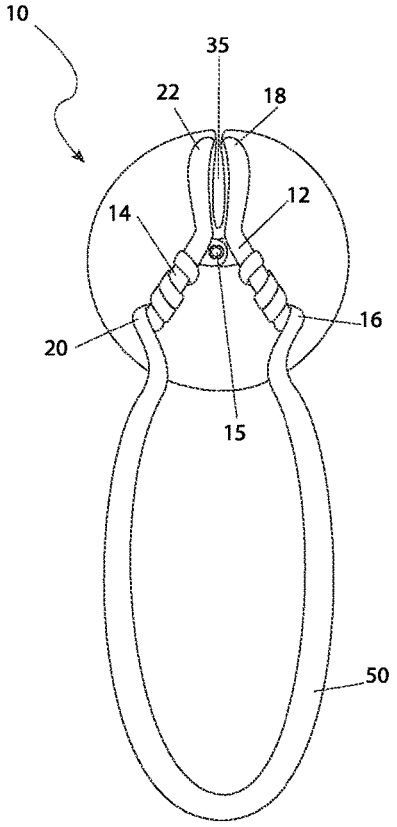
FIG. 6*a* is a cut a way view taken along the Lines A-A of FIG. 4 of the holding device, according to another alternate embodiment of the present disclosure.
Figure 6B:
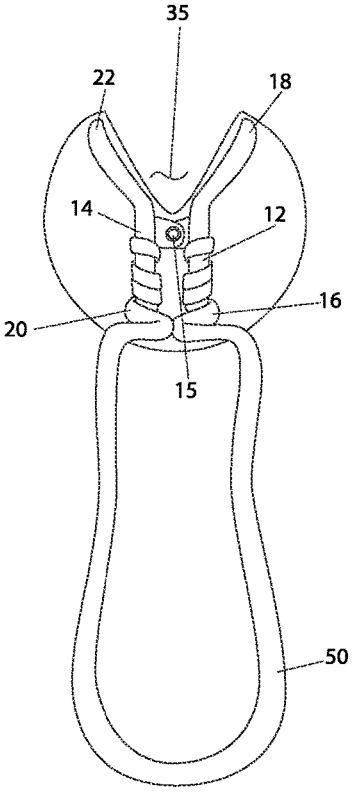
FIG. 6*b* is an opposite cut away side view taken along the Lines A-A of FIG. 4 of the holding device, according to another alternate embodiment of the present disclosure.
Figure 6C:
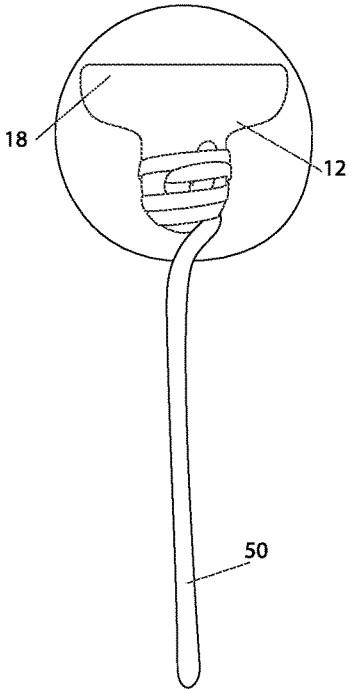
FIG. 6*c* is a cut away top view taken along the Lines B-B of FIG. 4 of the holding device, according to another alternate embodiment of the present disclosure.
Figure 7:
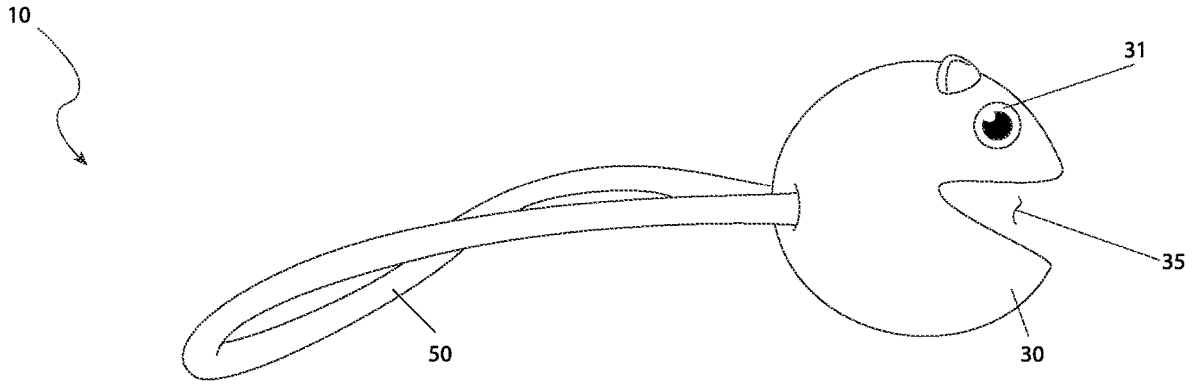
FIG. 7 is a side view of the holding device, according to the alternate embodiment of the present disclosure.
Figure 8:
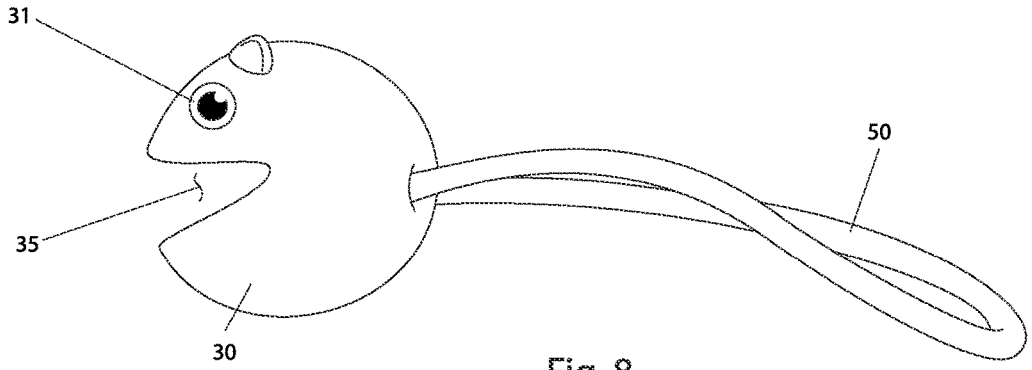
FIG. 8 is the opposite side view of the holding device, according to the alternate embodiment of the present disclosure.

Referring now to FIGS. 6*a*-6*c*, cut-away views of the holding device 10 are shown, illustrating an alternate embodiment of the invention. The loop first end 16 is attached, affixed, or otherwise bonded to a first clip grip 12. Similarly, the loop second end 20 is attached, affixed, or otherwise bonded to a second clip grip 14. In the illustrated embodiment, such attachment can be multiple windings of the respective loop end 16, 20 to the respective clip grip 12, 14. Extending away from the first clip grip 12 is a first clip jaw 18. The tip of the first clip jaw 18 terminates prior to the inner wall of the body 30 and the inner side of the first clip jaw 18 is parallel to a first inner wall of the cavity 35. Extending away from the second clip grip 14 is a second clip jaw 22. The tip of the second clip jaw 22 terminates prior to the inner wall of the body 30 and the inner side of the second clip jaw 22 is parallel to a second inner wall of the cavity 35.

A hinge 15 operatively connects the first clip grip 12 to the second clip grip 14 and designates the transition of the first clip grip 12 to the first clip jaw 18 and the second clip grip 14 to the second clip jaw 22. The hinge 15 may be a torsion spring or similar device to effectively bias the first clip jaw 18 and second clip jaw 22 towards each other, effectively closing the cavity 35, thereby creating a "closed" configuration. Movement of the first clip grip 12 and second grip clip 14 towards each other forces the first clip jaw 18 and second clip jaw 22 to move away from each other and effectively opening the cavity 35, thereby creating an "open" configuration.

Figure 5A:
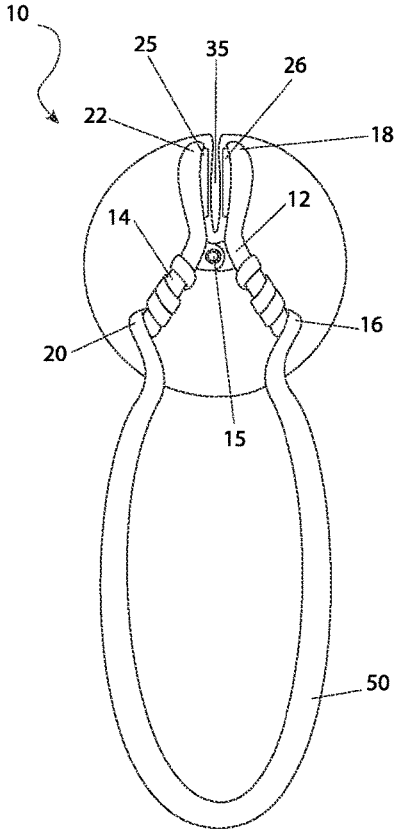
FIG. 5*a* is a cut a way view taken along the Lines A-A of FIG. 4 of the holding device, according to the alternate embodiment of the present disclosure.
Figure 5B:
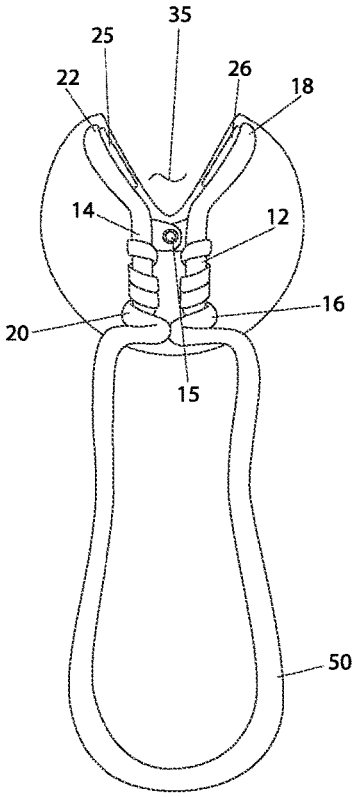
FIG. 5*b* is an opposite cut away side view taken along the Lines A-A of FIG. 4 of the holding device, according to the alternate embodiment of the present disclosure.
Figure 5C:
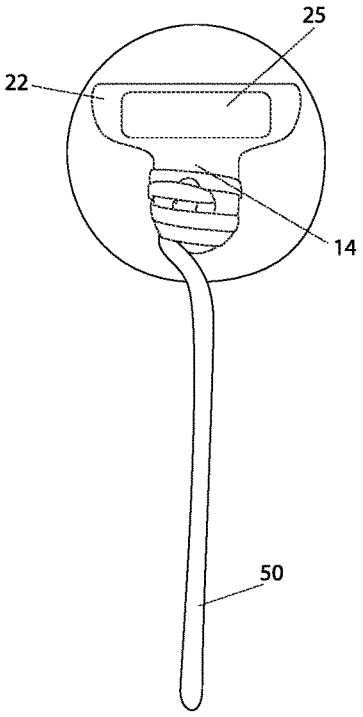
FIG. 5*c* is a cut away top view taken along the Lines B-B of FIG. 4 of the holding device, according to the alternate embodiment of the present disclosure.

Referring now more closely to FIGS. 5*a*-5*c*, cut-away views of the holding device 10 are shown, illustrating a preferred embodiment of the invention. The preferred embodiment retains identical or generally similar features as in the alternate embodiment previously described above. A first clip magnet 25 is attached, affixed, or otherwise bonded to the inner side of the second clip jaw 22 and a second clip magnet 25 is attached, affixed, or otherwise bonded to the inner side of the first clip jaw 18. The first clip magnet 25 and second clip magnet 26 are configured to have a strong magnetic attachment to each other, capable of being defeated upon a force delivered to the first clip grip 12 and second clip grip 14.

The first clip grip 12, first clip jaw 18, hinge 15, second clip grip 14 and second clip jaw 22 may be a unitary construction of a convention clip commonly used to clamp open bags closed, but not limited as such. The first clip magnet 25 and second clip magnet 26 are manufactured out of materials providing a strong, resilient, and durable magnetic attraction to each other, thereby also closing the cavity 35 to render the holding device 10 in the "closed" configuration and entrapping any device clamped therewithin,

2. Operation of the Preferred Embodiment

The preferred and alternate embodiments of the present invention can be utilized by the common user in a simple and effortless manner with little or no training. It is envisioned that the device 10 would be constructed in general accordance with FIGS. 1-3, or with through FIGS. 4-8. The user would procure the device 10 from conventional procurement channels.

Figure 9:
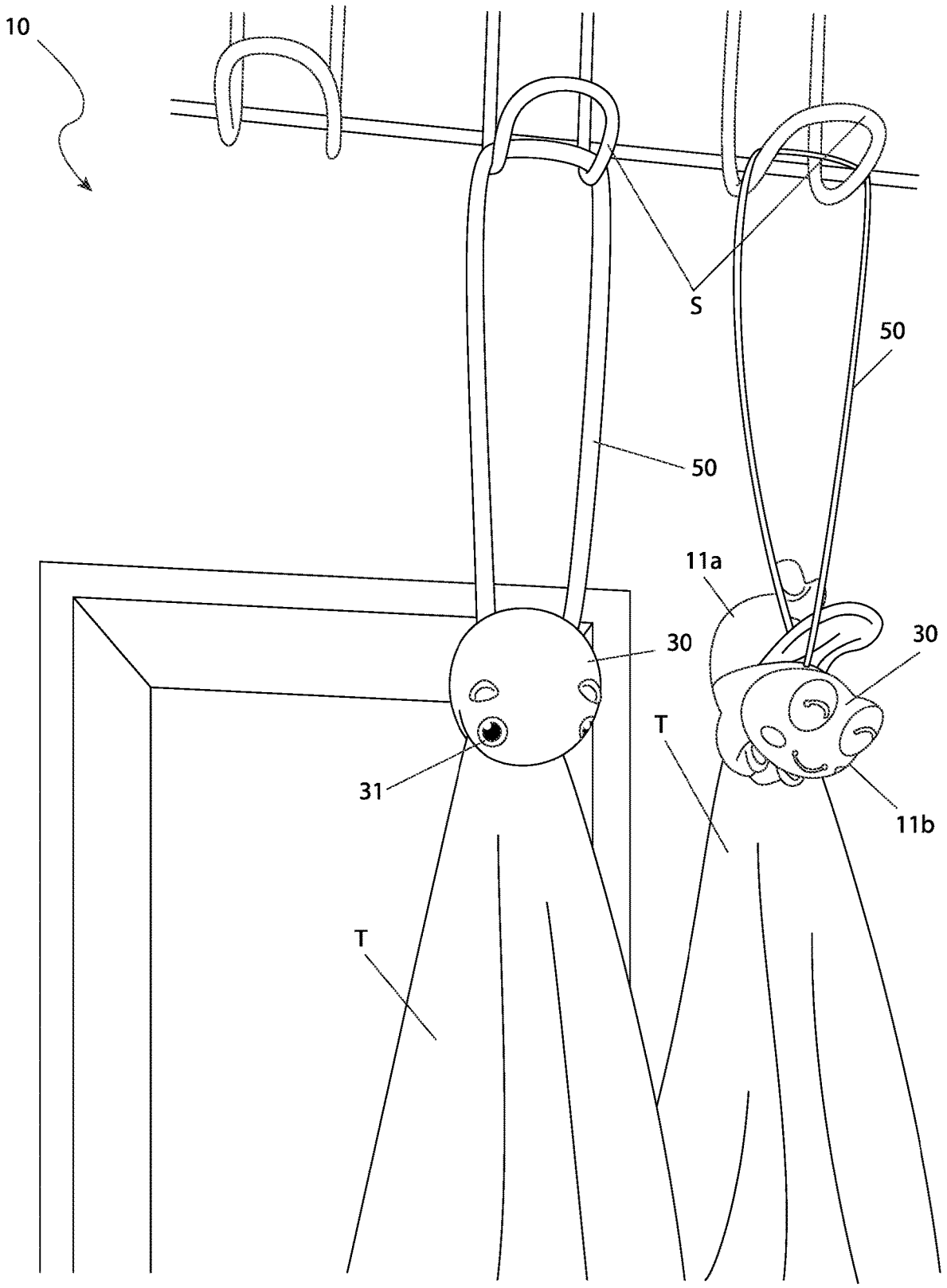
FIG. 9 is a perspective view of the holding device, showing both the preferred and alternate embodiments in a utilized state.

After procurement, a method of use of the preferred embodiment of the holding device 10 as shown in FIG. 9, is shown by a towel T effectively being held between the body first half 11*a* and body second half 11*b* and supported on a support structure S. The first magnet 40 within the first receiver 41 of the first body half 11*a* is magnetically attracted to the second magnet 45 within the second receiver 46 of the second body half 11*b*. When a towel T is placed within the gap and secured between the first body half 11*a* and second body half 11*b* via magnetic attraction of the first magnet 40 and second magnet 45, the towel T can be held by the holding device 10.

After procurement, a method of use of the alternate embodiment of the holding device 10 as shown in FIG. 9, is shown by a towel T being effectively held by the body 30 and supported on a support structure S. The holding device 10 is in the "closed" configuration. To achieve this, the first clip grip 12 and second clip grip 14 are manipulated by forcing them towards each other, and via the hinge 15, motion the first clip jaw 18 away from the second clip jaw 22 to open the cavity 35 to put the holding device 10 in an "open" configuration. A portion of the towel T is then inserted into to the cavity 35. The force on the first clip grip 12 and second clip grip 14 is released and via the hinge 15, the first clip jaw 18 is forced towards the second clip jaw 22 to close the cavity 35 back to the "closed" configuration to retain the portion of the towel T therein. The loop 50 is then capable of supporting the entire body 30 and towel T by placing the portion of the loop 50 that extends outward from the body 30 onto the support structure S. Alternately, the first clip magnet 25, if present, of the second clip jaw 22 can be magnetically attracted to the second clip magnet 26, if present, on the first clip jaw 18.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A holding device, comprising:

a body first half;

a body second half mating with the body first half that are adapted to hold an article and have an overall ornamentation; and a loop having a first end and a second end, the first end of the loop is attached, affixed, or otherwise bonded to an upper side of the body first half and the second end of the loop is attached, affixed, or otherwise bonded to the upper side of the body second half; and, wherein the loop first end is attached, affixed, or otherwise bonded to a first clip grip and the loop second end is attached, affixed, or otherwise bonded to a second clip grip;

wherein extending away from the first clip grip is a first clip jaw with a tip of the first clip jaw terminating prior to the inner wall of the body and the inner side of the first clip jaw is parallel to a first inner wall of a cavity;

wherein extending away from the second clip grip is a second clip jaw with a tip of the second clip jaw terminating prior to the inner wall of the body and the inner side of the second clip jaw is parallel to a second inner wall of the cavity;

wherein a hinge operatively connects the first clip grip to the second clip grip and designates the transition of the first clip grip to the first clip jaw and the second clip grip to the second clip jaw;

wherein the hinge is a torsion spring to bias the first clip jaw and the second clip jaw towards each other, closing the cavity, thereby creating a "closed" configuration; and, wherein movement of the first clip grip and the second grip clip towards each other forces the first clip jaw and the second clip jaw to move away from each other and effectively opening the cavity, thereby creating an "open" configuration.

2. The holding device, according to claim 1, wherein the body first half and the body second half are made of a soft, waterproof, and resilient synthetic silicone material that retains its shape after being manipulated.

3. The holding device, according to claim 1, wherein the overall ornamentation includes an animal-like appearance.

4. The holding device, according to claim 1, wherein the loop includes a first receiver and a second receiver.

5. The holding device, according to claim 4, wherein the first receiver includes a first receiver cradle disposed on a first side thereof.

6. The holding device, according to claim 5, wherein a first magnet is attached to the terminal portion of the first end of the loop and is retained within the first receiver cradle.

7. The holding device, according to claim 6, wherein the first magnet is permanently attached within the first cradle but is retained thereon.

8. The holding device, according to claim 6, wherein the first magnet is removably attached within the first cradle but is retained thereon.

9. The holding device, according to claim 4, wherein the first magnet is retained within the first receiver of the first body half it is magnetically attracted to a second magnet located within the second receiver of the second body half.

10. The holding device, according to claim 4, wherein the second receiver cradle is located on a first side thereof.

11. The holding device, according to claim 10, wherein a second magnet is attached to the terminal portion of the second end of the loop and is retained within the second receiver cradle.

12. The holding device, according to claim 11, wherein the second magnet is permanently attached within the second cradle but is retained thereon.

13. The holding device, according to claim 11, wherein the second magnet is removably attached within the second cradle but is retained thereon.

14. The holding device, according to claim 1, wherein the loop is made of material that allows the clip to retain a desired shape when manipulated that maintains durability and resistance to over-stretching and/or severing.

* * * * *